US006752091B2

(12) United States Patent
Glover et al.

(10) Patent No.: US 6,752,091 B2
(45) Date of Patent: Jun. 22, 2004

(54) FOLDING BANQUET TABLE

(75) Inventors: Richard W. Glover, Greenwood, IN (US); Nathan W. Heisey, Columbus, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/971,387

(22) Filed: Oct. 4, 2001

(65) Prior Publication Data

US 2002/0092445 A1 Jul. 18, 2002

Related U.S. Application Data

(60) Provisional application No. 60/261,606, filed on Jan. 12, 2001.

(51) Int. Cl.[7] ..... A47B 3/00

(52) U.S. Cl. ..... 108/168; 108/169; 108/132; 108/129

(58) Field of Search ..... 108/14, 167, 168, 108/169, 172, 174, 125, 129, 130, 131, 132, 35, 36; 248/291.1, 188.6, 439; 16/408, 409

(56) References Cited

U.S. PATENT DOCUMENTS

| | | | | | |
|---|---|---|---|---|---|
| 1,257,843 | A | * | 2/1918 | Gonyea | 108/93 |
| 2,115,323 | A | * | 4/1938 | Wuest | 108/149 |
| 2,223,193 | A | | 11/1940 | Tafel | |
| 2,542,394 | A | | 2/1951 | Cohen et al. | |
| 2,693,258 | A | * | 11/1954 | Fliesch | 190/11 |
| 2,697,018 | A | * | 12/1954 | Georgides | 108/43 |
| 2,715,558 | A | | 8/1955 | Bell | |
| 2,747,957 | A | | 5/1956 | Lencioni | |
| 2,871,076 | A | | 1/1959 | Mell | |
| 2,903,313 | A | * | 9/1959 | Block | 108/35 |
| 2,987,149 | A | * | 6/1961 | Finkelstein | 16/408 |
| 3,143,982 | A | | 8/1964 | Blink et al. | |
| 3,368,504 | A | | 2/1968 | Cohen | |
| 3,416,468 | A | | 12/1968 | Peterson et al. | |
| 4,415,199 | A | | 11/1983 | Wright | |
| 4,653,804 | A | | 3/1987 | Yoo et al. | |
| 4,658,735 | A | | 4/1987 | Holton | |
| 4,700,987 | A | | 10/1987 | Sraka et al. | |
| 4,826,244 | A | | 5/1989 | Choi | |
| 4,841,877 | A | * | 6/1989 | Virtue | 108/36 |
| 5,009,170 | A | | 4/1991 | Spehar | |
| 5,012,553 | A | | 5/1991 | Hardigg et al. | |
| 5,357,872 | A | | 10/1994 | Wilmore | |
| 5,390,610 | A | | 2/1995 | Gutgsell | |
| 5,394,808 | A | | 3/1995 | Dutro et al. | |
| 5,421,272 | A | | 6/1995 | Wilmore | |
| 5,443,020 | A | | 8/1995 | Price | |
| 5,461,989 | A | | 10/1995 | Grandclement et al. | |
| 5,501,157 | A | | 3/1996 | Westerburgen | |
| 5,540,158 | A | | 7/1996 | Ford | |
| 5,694,865 | A | | 12/1997 | Raab | |
| 5,732,637 | A | | 3/1998 | Raab | |
| 5,868,081 | A | | 2/1999 | Raab | |
| 5,921,623 | A | | 7/1999 | Nye et al. | |

(List continued on next page.)

FOREIGN PATENT DOCUMENTS

| | | | |
|---|---|---|---|
| JP | 108039 | * | 4/1997 |
| JP | 175244 | * | 7/1997 |
| WO | WO 94/12075 | | 6/1994 |

*Primary Examiner*—Janet M. Wilkens
(74) *Attorney, Agent, or Firm*—Barnes & Thornburg

(57) ABSTRACT

A folding table includes a table top and a frame. The frame includes side rails hinged together at a table folding axis so the table can be moved between a folded and an opened position. The table includes a latch to secure the table in the opened position. The table includes frame end reinforcement portions including bights extending between opposite frame side rails near the table top ends. The table includes a handle that is movable between a stowed and a carrying position, the handle being pivotable about a portion of a frame member.

37 Claims, 8 Drawing Sheets

U.S. PATENT DOCUMENTS 5,947,037 A 9/1999 Hornberger et al.
5,957,061 A 9/1999 Chang
6,032,585 A 3/2000 Pinch
6,050,202 A 4/2000 Thompson
6,058,853 A 5/2000 Pinch
6,058,854 A 5/2000 Tarnay et al.
6,112,674 A 9/2000 Stanford
6,431,092 B1 * 8/2002 Stanford ..... 108/132

* cited by examiner

FOLDING BANQUET TABLE

This application claims the benefit of Provisional Application No. 60/261,606, filed Jan. 12, 2001.

BACKGROUND AND SUMMARY OF THE INVENTION

The present invention relates to a folding table and particularly to a folding banquet table having two table top end portions that can fold between an opened table position having top surfaces of the table top end portions aligned in coplanar relation to form a large table surface and a collapsed or folded position having the table top end portions folded together.

Tables having two table sections coupled together for pivoting movement between an opened table position and a folded collapsed position are well known. Conventional folding tables typically include table legs that can fold against the table sections allowing the table sections to be folded together without interference from the table legs. See, for example, U.S. Pat. No. 5,445,085 to Westerburgen; U.S. Pat. No. 5,421,272 to Wilmore; U.S. Pat. No. 5,357,872 to Wilmore; U.S. Pat. No. 3,368,504 to Cohen; and U.S. Pat. No. 2,542,394 to Cohen et al, the disclosures of which are hereby incorporated by reference herein.

In the present application, a folding table is provided comprising a table top having opposite ends and a hinged tubular frame coupled to the table top. The table includes a frame having a handle pivotable about a frame member and movable between a carrying position extending from the table top and a stowed position adjacent the table top. The table includes a latching mechanism to automatically and releasably latch the frame to secure the table in the opened position. The table includes a frame having end reinforcement sections.

In the illustrative embodiment, the frame includes opposite side rails, a pair of rotatable pivot bars or cross members and a pair of bar mounts or sleeves to pivotably receive the pivot bars. The frame includes two end-reinforcing portions each portion having a bight coupled to the ends of two U-shaped frame members or pivot supports. The pivot bars and the pivot supports are connected end-to-end to form a loop. Each pivot bar is coupled to each pivot support so that each pivot bar can rotate inside each pivot support. Each end of each pivot bar is inserted into one of the sleeves of each pivot support for rotation. Each leg unit is coupled to one of the pivot bars so that each leg unit can swing back and forth when the respective pivot bar rotates.

The table includes a handle pivotably or rotatably coupled to a portion of the frame. The handle is movable between a carrying position and a stowed position. In the stowed position, the handle lies in a recess formed in the downwardly facing surface of the table top.

The frame and table top further include first and second portions coupled by a pair of hinges allowing a user to fold the table in half. The table includes a releasable latch that automatically latches the table in an unfolded or opened position when a user moves the table from the folded position to the opened position. To fold the table, a user manually unlatches the latch and folds the downwardly facing surface of one half or portion of the table top and frame toward the other.

Additional features of the present invention will become apparent to those skilled in the art upon consideration of the following detailed description of the invention exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
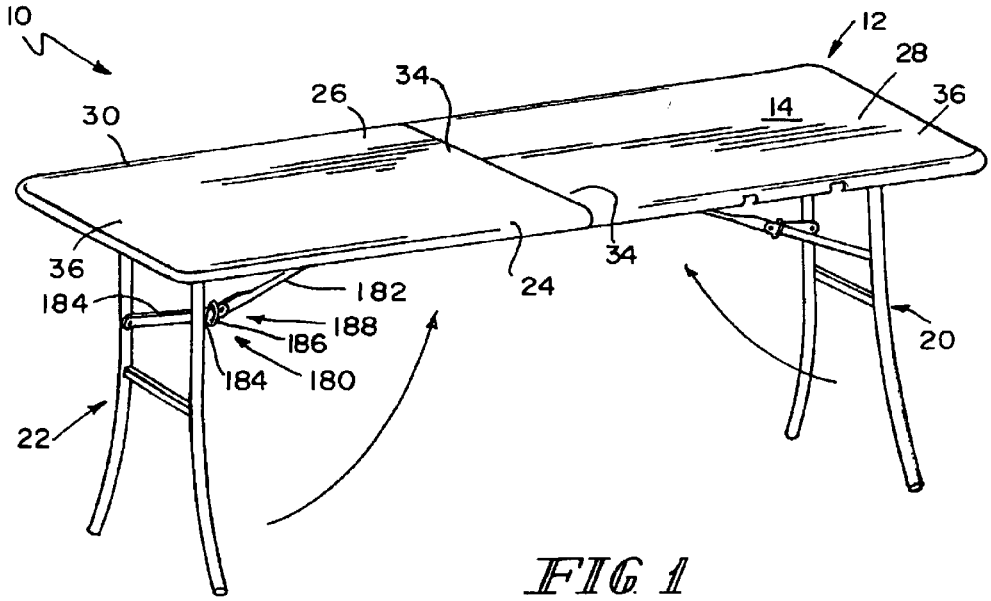
FIG. 1 is a perspective view of a table showing a two-part table top and leg units supporting opposite end portions of the table top.
Figure 2:
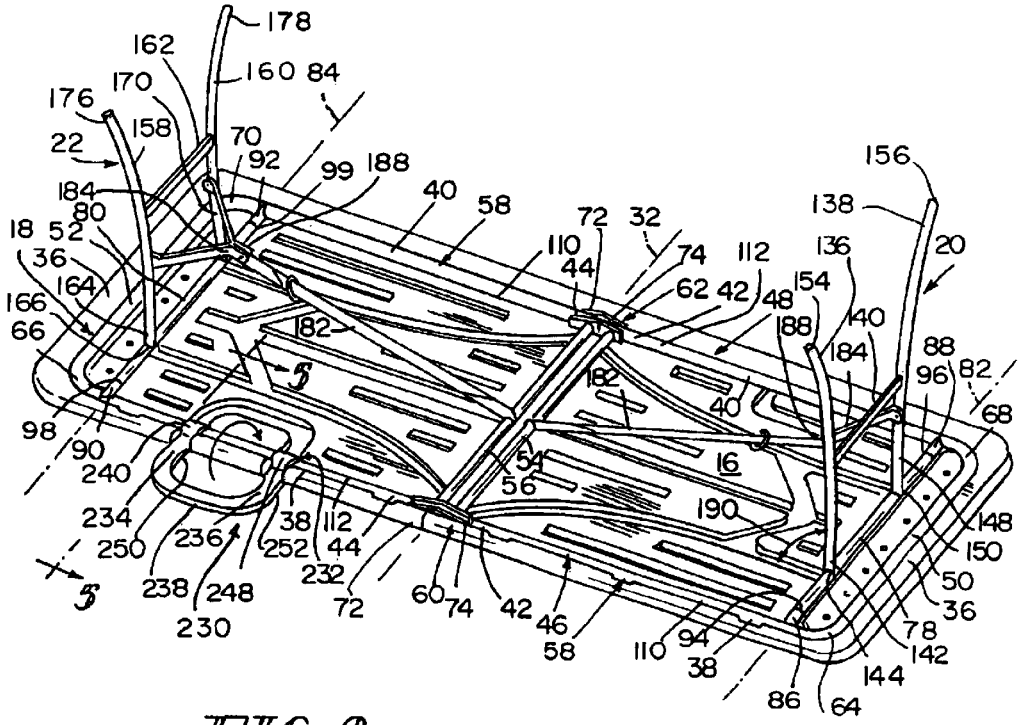
FIG. 2 is a perspective view of the underside of the table of FIG. 1 showing the table in an opened position and a support frame coupled to a downwardly facing surface of the table top.
Figure 3:
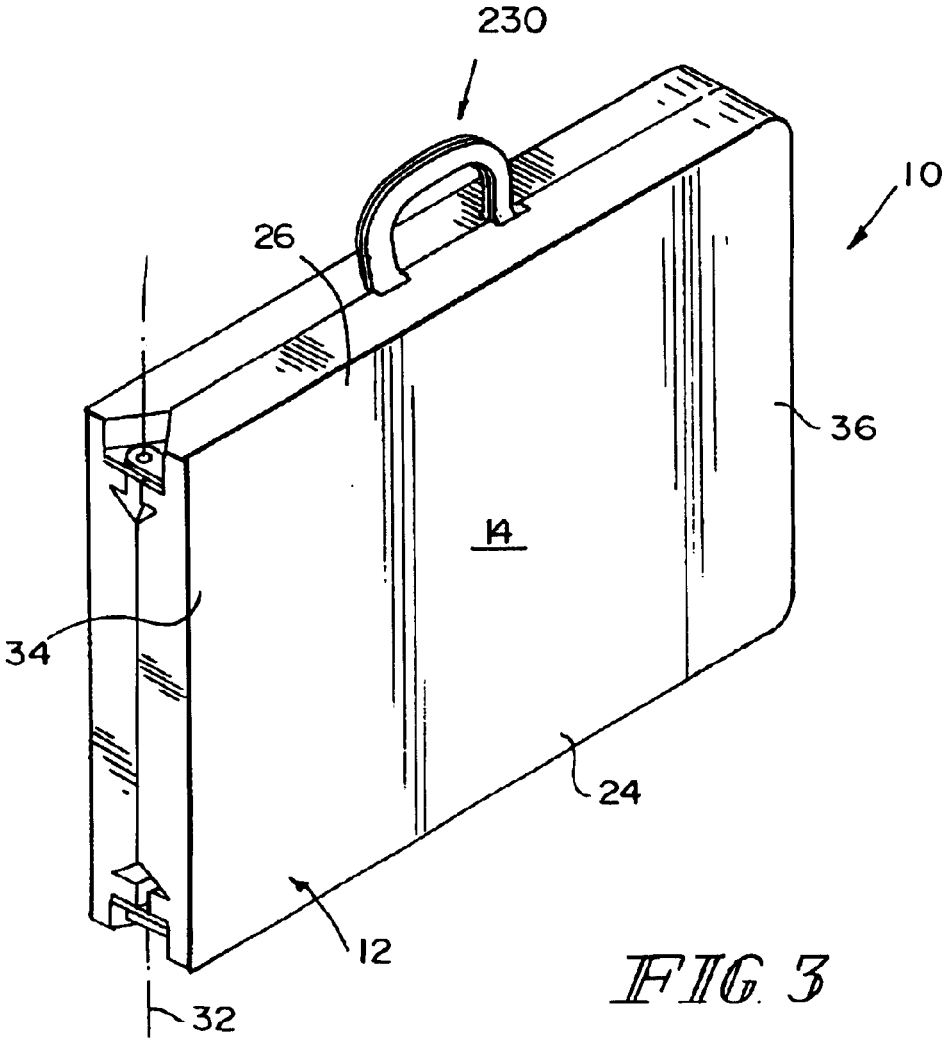
FIG. 3 is a perspective view of the table shown in a folded position with a handle in a carrying position extending from the table.

As shown in FIGS. 1–3, a table 10 includes a table top 12 having a top or upwardly facing surface 14 and a bottom or downwardly facing surface 16. Table 10 further includes a support frame 18 coupled to downwardly facing surface 16 and right and left-side leg units 20, 22 movably coupled to frame 18. Leg units 20, 22 are movable between a folded or collapsed position and an opened or extended position to support table top 12 above a floor.

As shown in FIGS. 1 and 2, table top 12 includes interior edges 34, opposite sides 24, 26, and opposite table top end portions 28, 30 separated by a central transversely extending folding axis or separation line 32. Each table top end portion 28, 30 includes an interior edge 34 and an outer edge or end 36. The table top 12 is foldable so that table top end portions 28, 30 may be folded together along folding axis 32 to facilitate storage or transportation.

As shown in FIG. 2, support frame 18 is coupled to downwardly facing surface 16 of table top 12 and extends generally around or near the perimeter of the table top 12 proximate opposite sides 24, 26, and outer edges or ends 36. Support frame 18 includes opposite side rails 38, 40, side rail 38 extending along side 24 of table top 12 and side rail 40 extending along side 26 of table top 12. Side rails 38, 40 are illustratively tubular, each having openings or open ends 42, 44 adjacent the separation line of table top 12. Side rails 38, 40 are hinged at the separation line to permit table top end portions 28, 30 to pivot relative to each other about axis 32 between a folded position as shown in FIG. 3 and an opened or use position as shown in FIGS. 1 and 2. When table 10 is in the opened position, the open ends 42, 44 of each of side rails 38, 40 are aligned with each other.

Support frame 18 includes first and second U-shaped side members or pivot supports 46, 48, each extending along one of opposite sides 24, 26 of table top 12, as shown in FIG. 2. Illustratively, first side member 46 includes side rail 38 and right and left elbows 64, 66 coupled to the ends of side rail 38. Second side member 48 includes side rail 40 and right and left elbows 68, 70 coupled to the ends of side rail 40.

Side members 46, 48 are joined together by bights 50, 52 extending along ends 36 of table top 12 and by cross supports 54, 56 extending along interior edges 34 of table top end portions 28, 30, forming a frame portion 58 extending around or near the perimeter of each table top end portion 28, 30 as illustrated in FIG. 2. Each frame portion 58 supports one of the table top end portion 28, 30 near the edges 34, 36 and sides 24, 26 of table top 12. First and second cross supports 54, 56 extend generally transversely across downwardly facing surface 16 of table top 12 from one of the opposite sides 24, 26 to the other such side. Cross supports 54, 56 are proximate interior edges 34 of respective table top end portions 28, 30.

Figure 8:
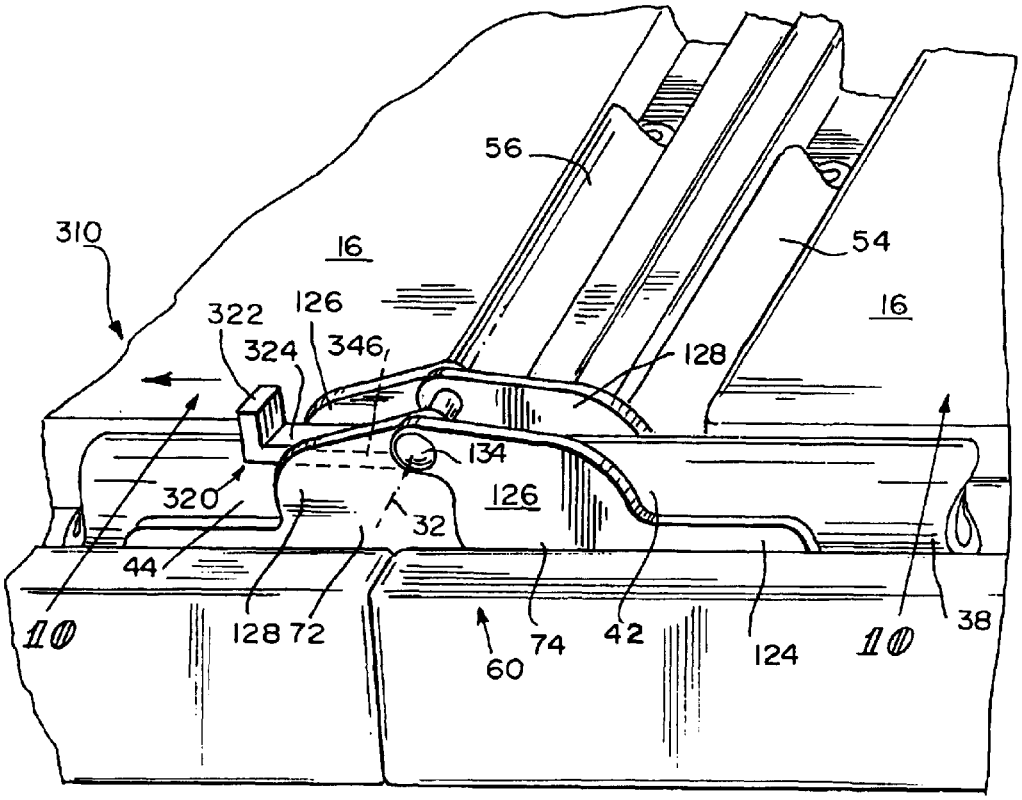
FIG. 8 is a perspective view of the table showing a portion of the downwardly facing surface of the table top and a latch mechanism cooperating with the frame to maintain the table in the opened position.
Figure 9:
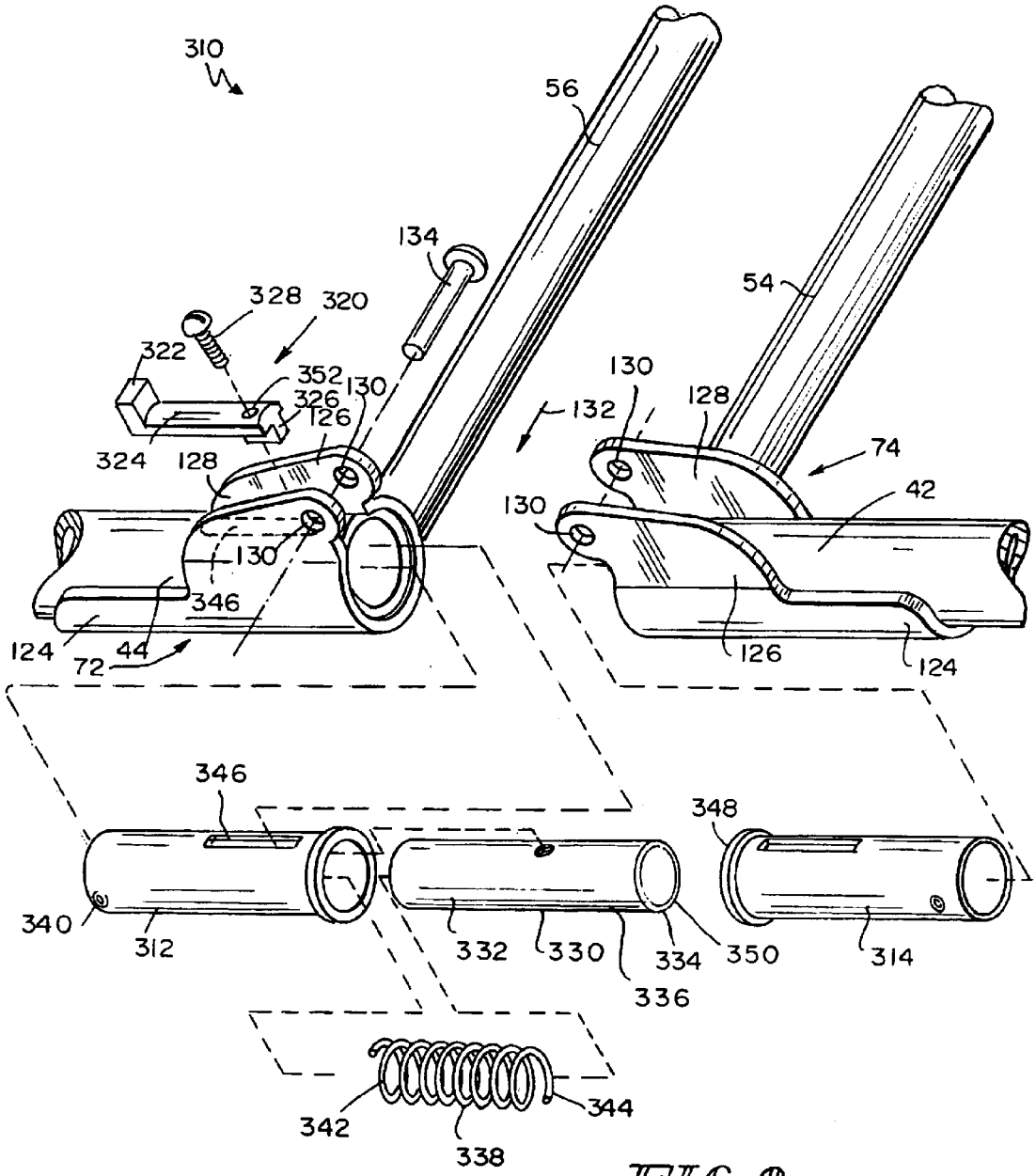
FIG. 9 is an exploded perspective view of the latch mechanism of FIG. 8.

As shown in FIG. 2, frame 18 includes first and second hinges 60, 62 coupled to open ends 42, 44 of respective side rails 38, 40 to permit frame 18, and thus table 10, to move between the folded and opened positions. Each hinge 60, 62 includes a first hinge member 72 coupled to open end 42 of each of side rails 38, 40, and a second hinge member 74 coupled to open end 44 of each of side rails 38, 40. As shown in FIGS. 8 and 9, first and second hinge members 72, 74 are joined by a retainer or pivot pin 76 that defines table folding axis 32. As illustrated in FIG. 2, cross supports 54, 56 extend between and are coupled to hinges 60, 62.

Each side member 46, 48 is pivotably coupled to one end of each of a first and a second leg pivot bars or tubular cross members 78, 80. First leg pivot bar 78 is coupled to right leg unit 20 and pivots about a right leg folding axis 82, permitting a user to move leg unit 20 between the collapsed or folded and the extended positions. Second leg pivot bar 80 is coupled to left leg unit 22 and pivots about a left leg folding axis 84, again permitting a user to move leg unit 22 between the collapsed and extended positions.

Frame 18 illustratively includes sleeves or bar mounts 86, 88, 90, 92 to receive the ends of leg pivot bars 78, 80 for pivoting movement of leg units 20, 22 about respective axes 82, 84. First leg pivot bar 78 is coupled to right ends of first and second side members 46, 48 so that first leg pivot bar 78 is rotatable about right leg folding axis 82 during folding or unfolding movement of right-side leg unit 20. First side member 46 illustratively includes a first right-side sleeve 86 coupled to the right end of the first side member 46, the sleeve configured to receive a first end 94 of first leg pivot bar 78 therein. Second side member 48 includes a second right-side bar mount or sleeve 82 coupled to the right end of second side member 48, the sleeve configured to receive an opposite second end 38 of first leg pivot bar 78 therein.

Second leg pivot bar 80 is coupled to left ends of first and second side members 46, 48 so that second leg pivot bar 80 can be rotated about axis 84 during pivoting movement of left-side leg unit 22. First side member 46 includes a first left-side sleeve or bar mount 90 configured to receive a first end 98 of second leg pivot bar 80 therein. Second side member 48 includes a second left-side bar mount 92 configured to receive an opposite second end 99 of second leg pivot bar 80 therein.

Frame 18 includes left elbow 66 coupled to side rail 38 near first left-side sleeve 90, right elbow 64 coupled to side rail 38 near first right-side sleeve 86, with side rail 38 interconnecting right and left elbows 64, 66 and positioned toward one of opposite sides 24, 26 of table top 12 as shown in FIG. 2. Frame 18 also includes a left elbow 70 coupled to side rail 40 near second left-side sleeve 74, a right elbow 68 coupled to side rail 40 near second right-side sleeve 88, with side rail 40 interconnecting the right and left elbows 68, 70 and positioned toward the other of opposite sides 24, 26 of table top 12 as shown in FIG. 2. Also as shown in FIG. 2, left and right bights 50, 52 extend along outer edges 36 of the opposite table top ends 28, 30. Left bight 50 extends between left elbows 66, 70, and right bight 52 extends between right elbows 64, 68.

Illustratively, frame 18 includes a frame portion 58 disposed to support each table top end portion 28, 30. Each side rail 38, 40 includes hinged first and second side rail portions or end portions 110, 112 so that each frame portion 58 is hinged to the other frame portion at the separation line. Frame 18 is configured so that each frame portion 58 provides a continuous, rigid support frame along the opposite sides 24, 26 and the interior and outer edges 34, 36 of table top end portions 28, 30. Illustratively, first portion 110 of side rail 38, second portion 112 of side rail 40, left elbows 66, 70, and bight 52 are constructed using a single tubular frame member. First portion 110 of side rail 40, second portion 112 of side rail 38, right elbows 64, 68, and bight 50 are also constructed using a single tubular member.

Frame 18 includes first and second hinges 60, 62 to couple one of the frame portions 58 to the other so that table 10 can be folded to a position shown in FIG. 3. Illustratively, first and second hinge members 72, 74 each are somewhat saddle-shaped and have a plate or channel 124 sized to receive open ends 42, 44 of one of the side rails 38, 40. Cross support 56 is coupled to and extends between first hinge members 72 of first and second hinges 60, 62. Cross support 54 is coupled to and extends between second hinge members 74 of first and second hinges 60, 62.

Each of first and second hinge members 72, 74 includes first and second upwardly extending arms 126, 128. As shown in FIG. 9, first and second arms 126, 128 of first hinge member 120 are formed to include apertures 130 therein.

First and second arms 126, 128 of second hinge member 74 are offset in a direction 132. First and second arms 126, 128 of first hinge member 72 are similarly offset so that first and second members 120, 122 of hinges 60, 62 may be joined by facing hinge members 72, 74 in opposing relationship as shown in FIGS. 8 and 9, aligning apertures 130 of each of arms 126, 128, and inserting a pivot pin 134 or other retainer through the aligned apertures. First and second members 72, 74 pivot relative to one another about table folding axis 32, permitting table top end portions 28, 30 to be folded together.

Table 10 includes a right-side leg unit 20, and a left-side leg unit 22. The leg units 20, 22 are mounted to pivot from a closed position shown in FIG. 3 to an opened position shown in FIG. 1 to support table top 12 in an elevated position above the floor. Support frame 18 is mounted to downwardly facing surface 16 of table top 12 to rigidify table top 12 and each leg unit 20, 22 is coupled to support frame 18 to permit pivotable movement of leg units 20, 22 relative to table top 12 as shown, for example, in FIGS. 1 and 2. For a description of a suitable leg unit that can be pivoted back and forth between the collapsed and opened positions, see the U.S. patent application having Ser. No. 09/742783, entitled "Banquet Table with Pivotable Legs," filed on Dec. 20, 2000, and naming as the inventor Larry L. Rumph, which disclosure is hereby incorporated by reference herein.

As shown in FIG. 2, right-side leg unit 20 is coupled to first cross member or pivot bar 78. Illustratively, first pivot bar 78 is one of the frame members or segments included in support frame 18. In use, first pivot bar 78 is mounted for rotation about an axis of rotation or leg folding axis 82 to pivot right-side leg unit 20 between the collapsed position and the extended position shown in FIG. 2.

Right-side leg unit 20 includes first and second legs 136, 138 and a leg cross member 140 extending between first and second legs 22, 24 as shown in FIG. 2. An upper end 142 of first leg 136 is coupled to first pivot bar 78 at a first location 144 that is spaced apart from a first end 146 of first pivot bar 78. An upper end 148 of second leg 138 is coupled to first pivot bar 78 at a second location 150 that is also spaced apart from an opposite second end 152 of first pivot bar 78. Lower ends 154, 156 of first and second legs 136, 138 are adapted to engage the floor when right-side leg unit 20 is moved to assume its extended position as shown, for example, in FIG. 1.

Left-side leg unit 22 is coupled to a second cross member or pivot bar 80 as shown in FIG. 2. Illustratively, second pivot bar 80 is another one of the frame members or segments included in support frame 18. In use, second pivot bar 80 is mounted to be rotated about an axis of rotation or leg folding axis 84 to pivot left-side leg unit 22 between the collapsed position and the extended position shown in FIG. 2.

Left-side leg unit 22 includes first and second legs 158, 160 and a leg cross member 162 extending between first and second legs 158, 160. An upper end 164 of first leg 158 is coupled to second pivot bar 80 at a first location 166 that is spaced apart from a first end 168 of second pivot bar 80. An upper end 170 of second leg 160 is coupled to second pivot bar 80 at a second location 172 that is likewise spaced apart from an opposite second end 174 of second pivot bar 80. Lower ends 176, 178 of first and second legs 158, 160 are adapted to engage the floor when left-side leg unit 22 is moved to assume its opened position as shown, for example, in FIG. 2.

A separate leg unit lock mechanism 180 is configured to brace each leg unit 20, 22 in the extended position, as shown in FIG. 1. Each lock mechanism 180 includes a first link 182 coupled to the underside of table top 12, illustratively through one of first or second cross supports 54, 56, a pair of second links 184 coupled to first link 182 and respective legs 136, 138, 158, 160 of respective leg units 20, 22, and a sliding ring 186. Positioning each ring 186 into its locking position so that ring 186 covers junction 188 of first and second links 182, 184 locks leg units 20, 22 in the extended position, as shown in FIGS. 1 and 2. Illustratively, in the extended position, each leg unit 20, 22 forms an angle 190 of 92 degrees measured from downwardly facing surface 16 of table top 12 in the direction each leg unit 20, 22 pivots away from the collapsed position toward the extended position. Moving sliding ring 186 from junction 188 permits respective leg units 20, 22 to pivot from the opened position back to the collapsed position.

Figure 7:
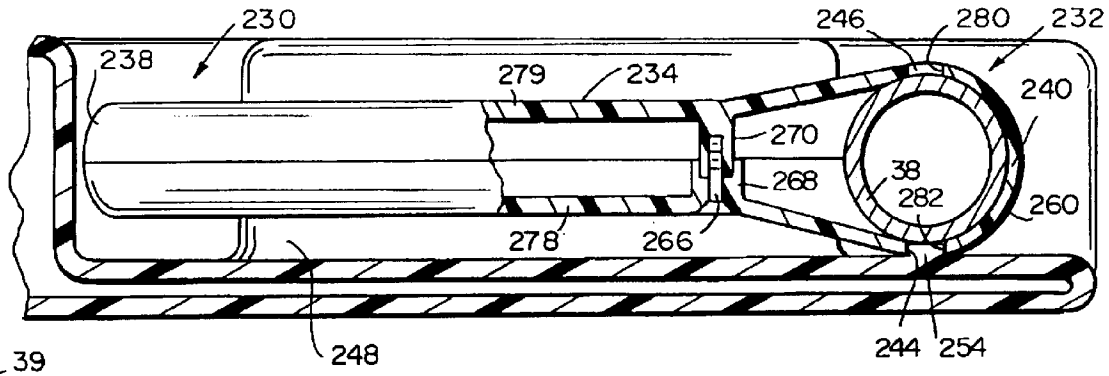
FIG. 7 is a sectional view similar to FIG. 5 showing the handle in a stowed position in a handle receiver formed in the downwardly facing surface of the table top.
Figure 5:
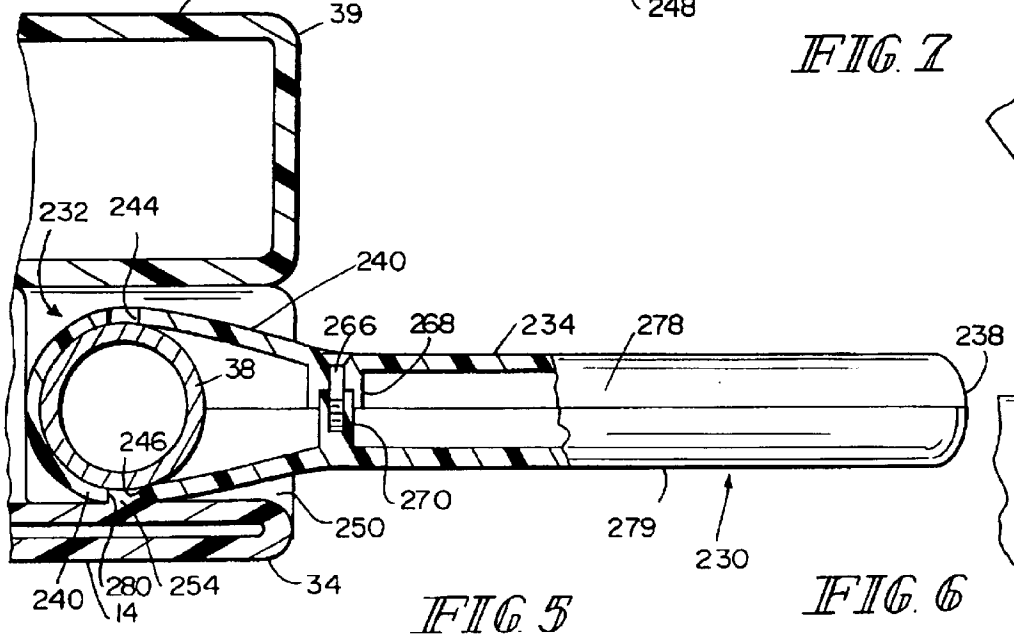
FIG. 5 is a sectional view taken along lines 5—5 of FIG. 2 showing the handle in the carrying position and showing a detent engaging a recess formed in a tubular portion of the handle, and showing the table top in the folded position.

Table 10 includes a handle 230 movable between a carrying position shown in FIGS. 2 and 5 and a stowed position as shown in FIG. 7. Handle 230 is pivotably or rotatably coupled to first side rail 40 and includes a coupler 232, first and second arms 234, 236 coupled thereto, and a hand grip 238 coupled to and extending between the arms. When handle 230 is assembled, as shown in FIG. 5, coupler 232 includes first and second generally tubular-shaped portions 240, 242 sized to receive first side rail 38.

Figure 6:
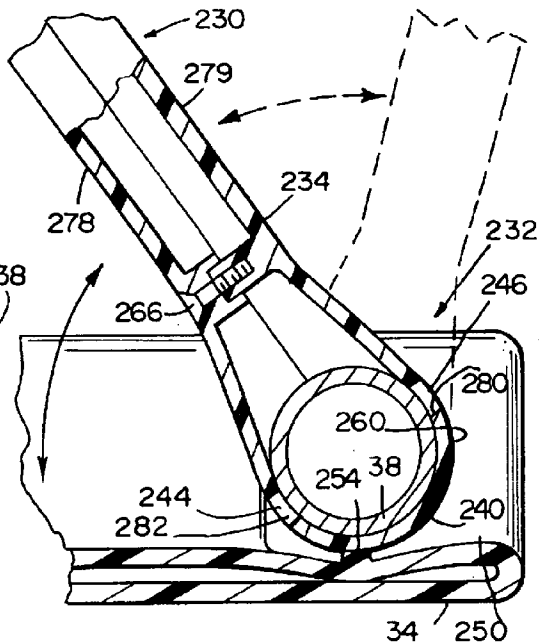
FIG. 6 is a sectional view similar to FIG. 5 showing the handle being moved from the stowed position toward the carrying position and showing a surface of the detent disengaged from the recess and the detent sliding along an outer surface of the tubular portion of the handle.

Each of first and second tubular portions 240, 242 of handle 230 include front and rear recesses 244, 246 as shown in FIGS. 4–7. As best shown in FIG. 2, bottom surface 16 of table top 12 includes a handle receiver 248 sized to receive handle 230 in a stowed position and two spaced-apart notches 250, 252 sized to receive arms 234, 236 when handle 230 is in its carrying position. As shown in FIGS. 5–7, notches 250, 252 each include complementary portions, illustratively detents 254, positioned to lie in one of the front or rear recesses 244, 246 when handle 230 is in its stowed or carrying position respectively.

When handle 230 is in its carrying position, as shown in FIG. 5, detents 254 engage rear recesses 246 of coupler 232, releasably securing handle 230 in the carrying position. When handle 230 is in its stowed position, as shown in FIG. 7, detents 254 engage front recesses 244 of coupler 232, releasably securing handle 230 in the stowed position. Because of the engagement of the detents and the recesses, tubular portions 240, 242 of the handle do not move freely about one of first or second pivot supports 46, 48, yet a user may apply minimal force to move the handle away from the stowed or carrying position.

As shown in FIGS. 5–7, as a user moves handle 230 from the stowed position toward the carrying position, detents 254 disengage second engagement surfaces or edges 282 of front recesses 244 of coupler 232. As the user continues to move the handle, the detents 254 and portions of notches are deformed as shown in FIG. 6 and outer surface 260 of tubular portions 240, 242 slides against detents 254. As the user positions handle 230 in the carrying position shown in FIG. 5, detents 254 "snap" into engagement with first engagement surfaces or edges 280 of rear recesses 246 of coupler 232. Although illustrative embodiments have included detents and recesses associated with the handle and the table top, it is within the scope of this disclosure to include any combination of complementary engagement surfaces that cooperate to inhibit movement of the handle from the carrying position and/or the stowed position.

Figure 4:
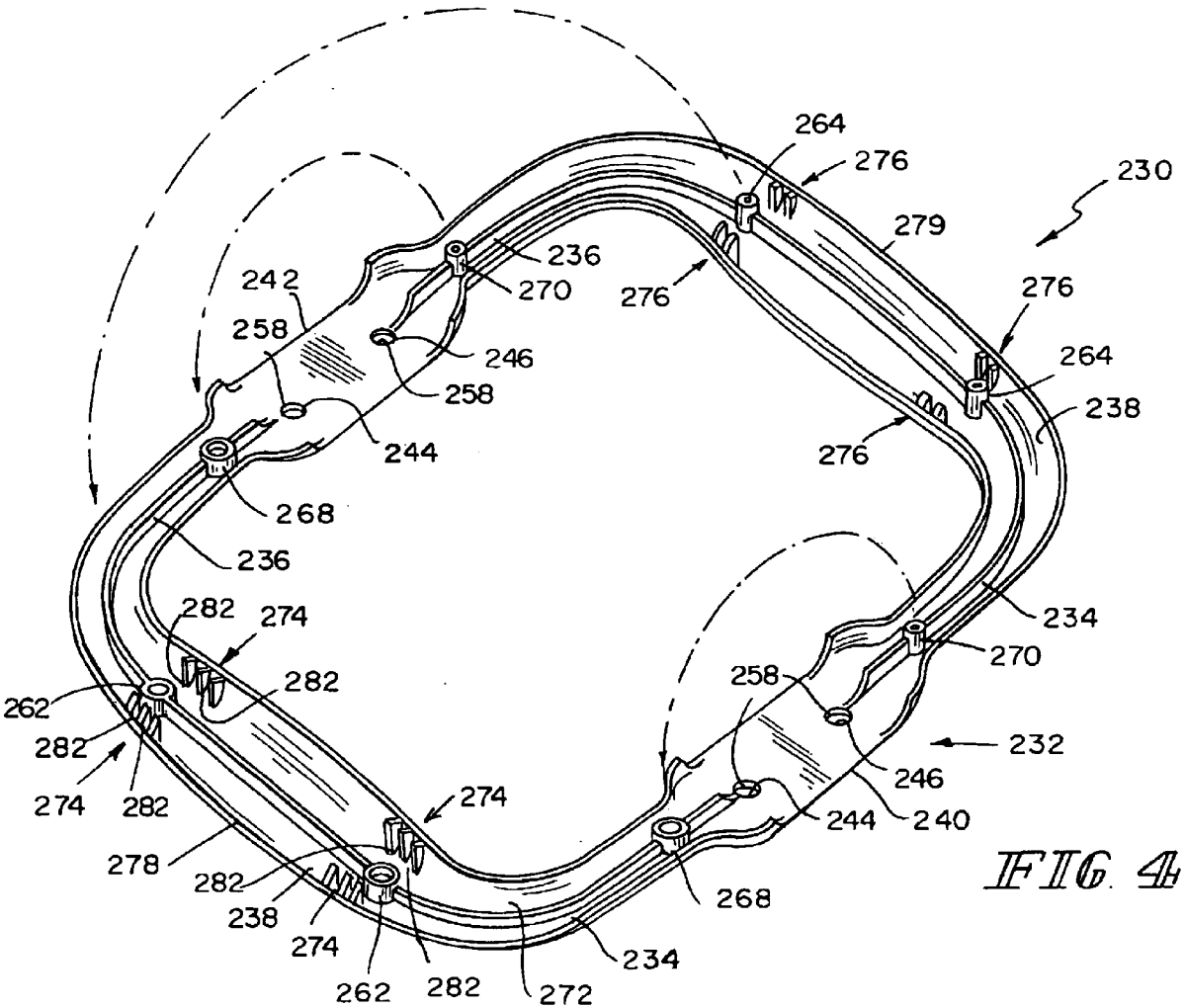
FIG. 4 is a perspective view of the handle shown in a disassembled state.

In its unassembled state as shown in FIG. 4, handle 230 has a generally rectangular shape and includes, in series, the first half of handgrip 238, the first half of first arm 234, the first half of first tubular portion 240, the second half of first tubular portion 240, the second half of first arm 234, the second half of hand grip 238, the second half of second arm 236, the second half of second tubular portion 242, the first half of second tubular portion 242, and the first half of second arm 236. The first half of handgrip 238 includes two retainer-receiving apertures 262. The second half of handgrip 238 includes two bosses 264 sized to receive handle retainers 266. The first half of each arm 234, 236 includes a screw-receiving aperture 268. The second half of each arm 234, 236 includes a boss 270 sized to receive a handle retainer 266.

To assemble handle 230, a reverse side 272 of the tubular portions 240, 242 of coupler 232 is held firmly against first side rail 38. First and second halves 278, 279 of handle 230 are folded around the side rail until a reverse side 272 of first half 278 is folded against the reverse side 272 of second half 279. In this position, part of side rail 38 is positioned within tubular portions 240, 242 of coupler 232. Retainers 266 are inserted through the retainer apertures 262, 268 and into the bosses 264, 270 forming an assembled handle as shown in FIG. 5. The handle 230 may be constructed with molded plastic and assembled onto frame 18 by folding handle 230 around the frame shortly after removal from a mold when the plastic is somewhat more pliable.

As shown in FIG. 4, first and second placement fingers 274, 276 are coupled to reverse side 272 of handle 230 and serve to properly align first and second halves 278, 279 of handle 230 when the handle is assembled as detailed above. Illustratively, two sets of three first fingers 274 are provided and positioned on the first half 278 of handle 230 in spaced apart relation. Two sets of two second fingers 276 are positioned on the second half 279 of handle 230 in spaced apart relation. As a person assembling handle 230 folds first half 278 and second half 279 together, second fingers 276 are guided into slots 282 formed between the first fingers 274, thus properly aligning each retainer aperture 262, 268 with each corresponding boss 264, 270.

Table 10 includes a releasable latch 310 for automatically latching table 10 in the opened position when a user moves the table from a folded position to the opened position. As depicted in FIGS. 10–15, a user manually releases latch 310 to fold table 10, and latch 310 automatically latches the table in an opened position when a user moves the table to the opened position.

Figure 10:
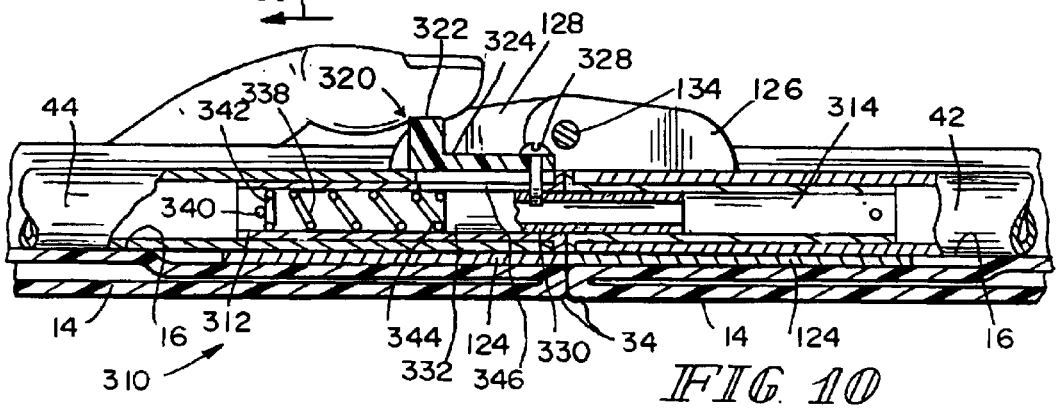
FIG. 10 is a fragmentary sectional view taken along line 10—10 of FIG. 8 showing the table in a closed position and a user engaging an actuator to manually release the latch mechanism.
Figure 15:
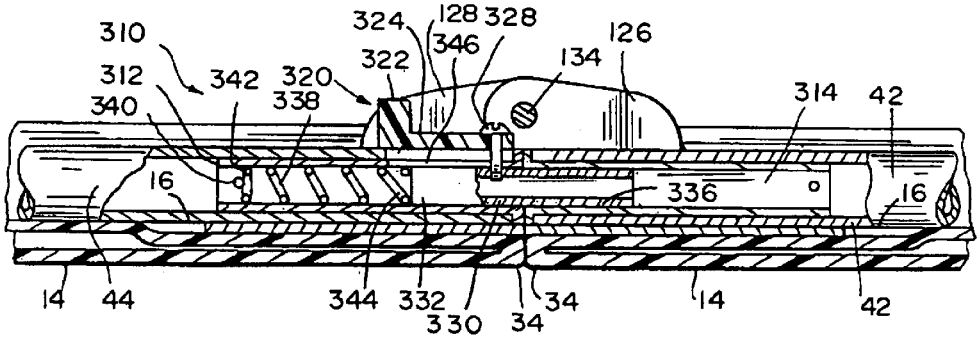
FIG. 15 is a fragmentary sectional view similar to FIG. 14 showing the table in an opened position, with the protruding member extending into opposing sleeves to latch the table in the opened position.

As shown in FIGS. 8 and 9, latch 310 includes a first latch sleeve 312 positioned to lie within open end 44 of first side rail 38 and a second latch sleeve 314 positioned to lie within open end 42 of first side rail 38. Latch 310 further includes an actuator 320 having a trigger 322 coupled to a link 324. Link 324 is coupled to a guide spacer 326 formed to include an aperture 352 through which a retainer 328 is inserted. Latch 310 also includes a protruding member or locking member 330 positioned to lie partially in each of first and second latch sleeves 312, 314 when protruding member 330 is in a normal at-rest position or locking position, as shown in FIGS. 10 and 15. Protruding member 330 includes a first end 332 and a surface 334 positioned at a second end 336 of the protruding member.

A biasing member such as spring 338 is positioned to lie within first latch sleeve 312 and illustratively includes a first end 342 adjacent a closed end of first latch sleeve 312 and a second end 344 adjacent a first end 332 of protruding member 330. In the embodiments shown in FIGS. 9–15, first spring end 342 engages a crimp or inwardly extending surface 340 of first latch sleeve 312. Second spring end 344 of spring 338 biases against protruding member 330, forcing second end 336 of protruding member 330 into second latch sleeve 314 when open ends 42, 44 of side rails 38, 40 are aligned.

First portion 316 of first pivot support 46 and first latch sleeve 312 are each formed to include a slot 346. Slots 346 are assembled to be positioned in alignment with each other, allowing guide spacer 326 to be slidably received in the slots. Retainer 328 is inserted through aperture 352 of guide spacer 326 and coupled to protruding member 330. Although latch 310 has been associated with pivot support 46 herein, it is within the scope of this disclosure to associate latch 310 with either of pivot supports 46, 48.

Figure 12:
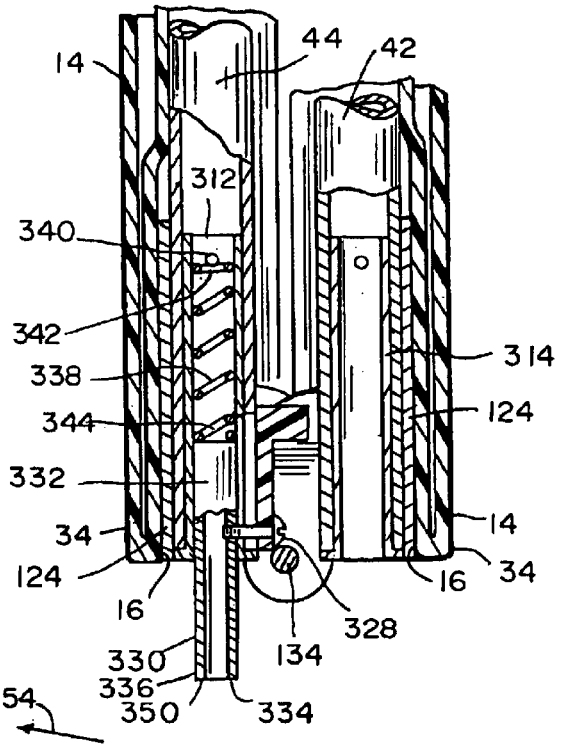
FIG. 12 is a fragmentary sectional view similar to FIG. 10 showing the table in a folded position with one of the opposite table top end portions folded against the other.
Figure 11:
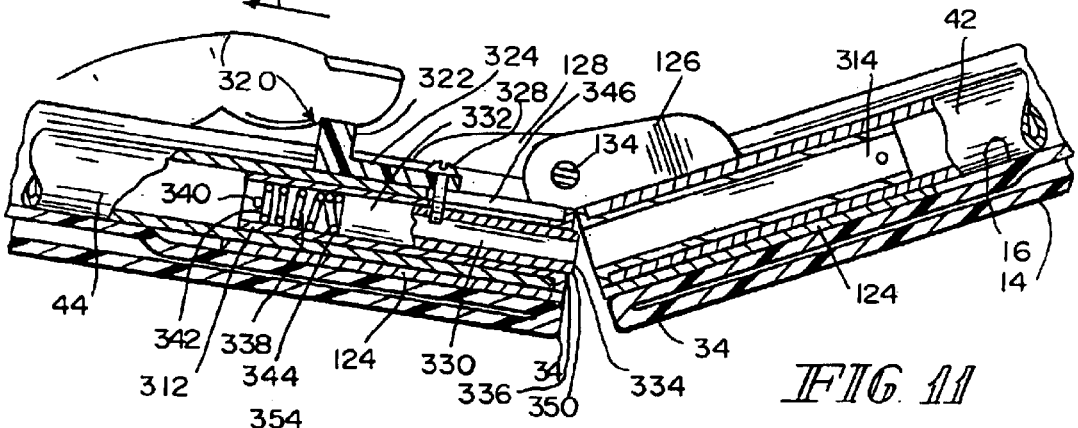
FIG. 11 is a fragmentary sectional view similar to FIG. 10 showing a user pulling a trigger of the actuator and releasing the latch mechanism to begin to fold the table.

In operation, as shown in FIGS. 10–12, to move the table from an opened position as shown in FIG. 10, to a closed or folded position as shown in FIG. 12, a user manually releases latch 310 by pulling on trigger 322. By pulling trigger 322 in direction 354, the user moves link 324 and guide spacer 326 away from second latch sleeve 314. By pulling trigger in direction 354, a user thus moves protruding member 330 in the same direction until a majority of protruding member 330 is removed from second latch sleeve 314, as shown in FIG. 11, permitting movement of one of table top end portions 28, 30 with respect to the other such end portion.

Figure 14:
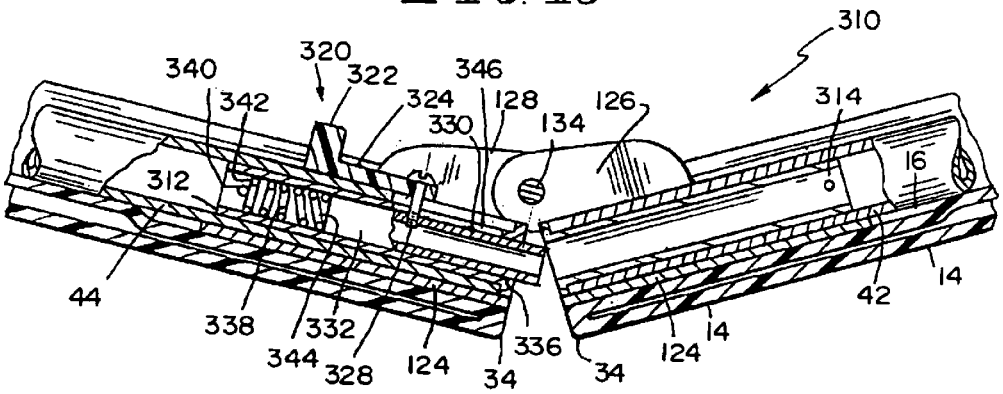
FIG. 14 is a fragmentary sectional view similar to FIG. 13 showing the table between the position shown in FIG. 13 and the opened position, with the protruding member positioned to enter the opposing sleeve.
Figure 13:
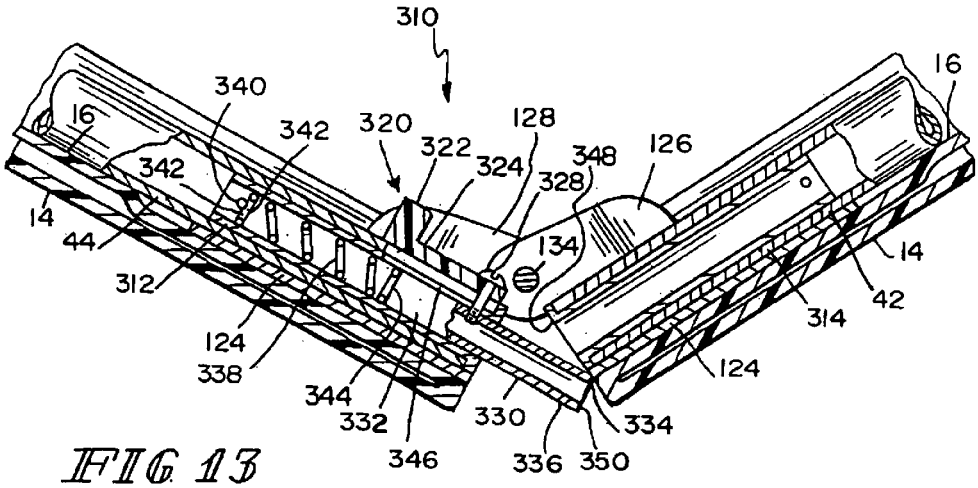
FIG. 13 is a fragmentary sectional view similar to FIG. 10 showing the table between the folded and opened positions and a protruding member of the latch engaging an outer surface and starting to move against the bias of a spring to permit movement of the table to the opened position.

As shown in FIGS. 13–15, movement of table 10 to the opened position shown in FIG. 15 causes latch 310 to automatically lock table 10 in the opened position. To open table 10, a user pivots downwardly facing surface 16 of one of the opposite table top end portions 28, 30 of table top 12 away from the downwardly facing surface of the other such portion. As surface 334 of second end 336 of protruding member 330 contacts outer edge 348 of second latch sleeve 314, and a user continues to move the table to the opened position, surface 334 slides along outer edge 348 until tip 350 clears outer edge 348 of second latch sleeve 314. Spring then biases second end 336 of protruding member 330 into second latch sleeve 314. The residence of protruding member in second latch sleeve 314 serves to releasably latch table 10 in the opened position shown in FIG. 15 and prevent undesired folding of the table.

Although the invention has been described in detail with reference to certain embodiments, variations and modifications exist within the scope and spirit of the invention as shown and described.

What is claimed is:

1. A table comprising a table top having opposite sides and opposite ends, an upwardly facing surface, and a downwardly facing surface, a tubular frame disposed to support the table top, the frame having a side rail extending along each opposite side, a bight extending along each opposite end to join the side rails, cross supports spaced inwardly from each bight, and a tubular cross member spaced inwardly from each bight and extending transversely between the side rails to define a transverse leg folding axis, the cross member being supported by the side rails for rotation about the transverse axis, a leg unit coupled to each cross member, each leg unit being foldable between a folded position extending toward the opposite end of the table top to lie adjacent the downwardly facing surface and an extended position to support the table top above the floor, and a lock mechanism extending between the cross support and the leg unit to support the leg unit in its extended position.

2. The table of claim 1, wherein the table top comprises opposite end portions separated along a central transversely extending separation line to be foldable such that the downwardly facing surface of one end portion faces the downwardly facing surface of the other end portion and each side rail includes first and second side rail portions hinged at the separation line about a transverse central axis below the downwardly facing surface.

3. The table of claim 2, wherein, under each table top end portion, the first and second side rail portions and the bight are a single tubular frame member and each cross member is supported by the associated first and second side rail portions to support the leg unit attached thereto.

4. The table of claim 2, wherein each of the first and second side rail portions includes a sleeve for supporting the associated cross member, the sleeve extending transversely toward the opposite side of the table top.

5. The table of claim 2, wherein the cross supports include a transversely extending cross support for each table top end portion positioned adjacent the separation line, each cross support having ends coupled to the side rails.

6. The table of claim 2, wherein a locking member is mounted for movement on the first side rail portion of at least one side rail, the locking member being movable between a locking position engaging the first and second side rail portions to support the table in an unfolded position and prevent rotation of the first and second side rail portions about the transverse central axis, and a retracted position disengaging the second side rail portion to permit rotation of the first and second side rail portions about the transverse central axis.

7. The table of claim 6, wherein the first and second side rail portions are tubular to provide aligned openings adjacent the central axis and sized to receive the locking member, and the locking member extends into the aligned openings in its locking position to prevent rotation of the first and second side rail portions.

8. The table of claim 1, wherein the table comprises a handle movable between a stowed position adjacent the table top and a carrying position extending from the table top, the handle having a handgrip and a coupler mounted to the frame for movement relative to the frame.

9. The table of claim 8, wherein the coupler extends around at least a portion of one of the side rails and is rotatable about the side rail.

10. A table comprising a table top having opposite sides and opposite ends, an upwardly facing surface, a downwardly facing surface, the table top also comprising opposite table top end portions separated along a transversely extending separation line, a frame disposed to support the table top, a side rail extending along each opposite side, each side rail having opposite side rail end portions separated at the separation line, the opposite side rail end portions being hinged together at the separation line, each side rail being tubular to provide, at each side of the table top, an open end adjacent and aligned with the open end of the other of the side rails at the side of the table top and at the separation line, a locking member movable between a locking position extending into both aligned open ends on the at least one side of the table top when the table is in its unfolded position and a retracted position extending into one of the open ends to permit movement of one opposite table top end portion relative to the other opposite table top end portion, and a biasing member arranged to bias the locking member to its locking position.

11. The table of claim 10, further comprising a handle including a hand grip and a coupler rotatable about a first of the side rails for movement of the hand grip between carrying and stowed positions.

12. The table of claim 11, wherein the coupler includes a collar extending around the first side rail for rotation thereabout.

13. The table of claim 10, wherein the biasing member includes a coil spring that is positioned in a first of the side rails and engages the locking member.

14. The table of claim 13, further comprising a first sleeve positioned within the first side rail, and the coil spring and the locking member are positioned within the first sleeve.

15. The table of claim 14, further comprising a second sleeve positioned within a second of the side rails, and, in the locking position, the locking member extends into the second sleeve.

16. The table of claim 10, further comprising an actuator to move the locking member against a biasing force exerted by the biasing member.

17. The table of claim 16, further comprising a sleeve positioned within a first of the side rails, wherein the actuator extends through a slot formed in the first side rail and a slot formed in the sleeve and is coupled to the locking member which is positioned within the sleeve.

18. A folding table comprising first and second opposite table end portions foldable together along a central transverse separation line, a frame mounted on each table end portion, the frame on one end portion providing an opening adjacent the separation line, a locking member coupled to the other frame and being movable to engage the opening to secure the table end portions in the same plane and to disengage the opening to permit the table end portions to be folded together, and a biasing member arranged to bias the locking member toward engagement with the opening when the first and second opposite table end portions are unfolded.

19. The table of claim 18, further comprising a handle including a hand grip and a collar rotatable on one of the frames for movement of the hand grip between carrying and stowed positions.

20. The table of claim 18, wherein the other frame includes a tubular rail and the biasing member includes a coil spring that is positioned within the tubular rail and engages the locking member.

21. The table of claim 20, further comprising a sleeve positioned within the rail, and the coil spring and the locking member are positioned within the sleeve.

22. The table of claim 18, further comprising an actuator to move the locking member against a biasing force exerted by the biasing member.

23. The table of claim 22, further comprising a sleeve, wherein the other frame includes a tubular rail, the sleeve is positioned within the rail, and the actuator extends through a slot formed in the rail and a slot formed in the sleeve and is coupled to the locking member which is positioned within the sleeve.

24. A table comprising a table top having opposite sides and opposite ends, an upwardly facing surface, a downwardly facing surface, the table top comprising opposite table top end portions separated along a central transversely extending separation line to be foldable, a tubular frame disposed against the downwardly facing surface to support the table top, the frame having a side rail extending along each opposite side, each side rail having opposite side rail end portions separated at the separation line, the opposite side rail end portions being hinged together at the separation line, one side rail end portion providing an opening adjacent to the separation line, and the other side rail end portion carrying a locking member, the locking member being movable between a locking position engaging the opening to secure the table top in the opened position, the locking member having a position retracted away from the opening to permit relative movement of the side rails when the locking member is in the retracted position, wherein the table is moveable between a folded position and an opened position and the locking member is biased to extend into the opening in its locking position when the table is in the opened position.

25. A table comprising a table top having opposite sides and opposite ends, an upwardly facing surface, a downwardly facing surface, the tabletop comprising opposite table top end portions separated along a central transversely extending separation line to be foldable, a tubular frame disposed against the downwardly facing surface to support the table top, the frame having a side rail extending along each opposite side, each side rail having opposite side rail end portions separated at the separation line, the opposite side rail end portions being hinged together at the separation line, one side rail end portion providing an opening adjacent to the separation line, and the other side rail end portion carrying a locking member, the locking member being movable between a locking position engaging the opening secure the table top in the opened, the locking member having a portions portion retracted away from the opening to permit relative movement of the side rails when the locking member is in the retracted position, wherein the locking member is configured to automatically move to engage the opening when the table is moved from the folded position to the opened position.

26. The table of claim 25 comprising a spring to bias the locking member to automatically move when the table is moved from the folded position to the unfolded position.

27. A table comprising a table top having opposite sides and opposite ends, an upwardly facing surface, a downwardly facing surface, the table top comprising opposite table top end portions separated along a central transversely extending separation line to be foldable, a tubular frame disposed against the downwardly facing surface to support the table top, the frame having a side rail extending along each opposite side, each side rail having opposite side rail end portions separated at the separation line, the opposite side rail end portions being hinged together at the separation line, one side rail end portion providing an opening adjacent to the separation line, and the other side rail end portion carrying a locking member, the locking member being movable between a locking position engaging the opening to secure the table top in the opened position, the locking member having a position retracted away from the opening to permit relative movement of the side rails when the locking member is in the retracted position, wherein the opening includes a sleeve to receive the locking member when the locking member is in its locking position.

28. The table of claim 24, wherein each of the opposite side rail end portions includes a latch sleeve to receive the locking member, one of the latch sleeves including a radially inwardly extending surface to engage a spring.

29. The table of claim 28, wherein the locking member extends substantially into one of the latch sleeves when the locking member is in the retracted position.

30. A table comprising a table top having an upwardly facing surface and a downwardly facing surface, a frame coupled to the downwardly facing surface, and a handle movable between a carrying position and a stowed position, the handle having a handgrip and a coupler rotatably mounted on the frame to support the hand grip for movement relative to the frame.

31. A table comprising a table top having an upwardly facing surface and a downwardly facing surface, a frame coupled to the downwardly facing surface, and a handle movable between a carrying position and a stowed position, the handle having a handgrip and a coupler mounted to the frame and extending at least partially around the frame to support the hand grip for movement relative to the frame, wherein the coupler is saddle shaped and extends around a portion of the frame to permit pivoting movement of the handle relative to the frame.

32. A table comprising a table top having an upwardly facing surface and a downwardly facing surface, a frame coupled to the downwardly facing surface, and a handle movable between a carrying position and a stowed position, the handle having a handgrip and a coupler mounted to the frame and extending at least partially around the frame to support the hand grip for movement relative to the frame, wherein the coupler engages the downwardly facing surface of the table top to inhibit movement of the handle from at least one of the stowed and carrying positions.

33. The table of claim 32, wherein the bottom surface of the table top provides a complementary portion to engage the coupler to inhibit movement of the handle from at least one of the stowed and carrying positions.

34. A table comprising a table top having an upwardly facing surface and a downwardly facing surface, a frame coupled to the downwardly facing surface, and a handle movable between a carrying position and a stowed position, the handle having a handgrip and a coupler mounted to the frame and extending at least partially around the frame to support the hand grip for movement relative to the frame, wherein the bottom surface of the table top provides a handle recess sized to receive at least a portion of the handle when the handle is in the stowed positions.

35. The table of claim 34, wherein the bottom surface provides a handgrip recess to receive the handgrip when the handle is in the stowed position, the bottom surface further providing a notch to receive the coupler when the handle is in the carrying position.

36. A table comprising a table top having an upwardly facing surface and a downwardly facing surface, a frame coupled to the downwardly facing surface, and a handle movable between a carrying position and a stowed position, the handle having a handgrip and a coupler mounted to the frame and extending at least partially around the frame to support the hand grip for movement relative to the frame, wherein the coupler provides a front recess and a rear recess each providing an edge to engage the bottom surface of the table top, one of the edges of one of the front or rear recesses engaging the bottom surface of the table top to inhibit movement of the handle from the stowed position and the other edge of the other of the front or rear recesses engaging the bottom surface of the table top to inhibit movement of the handle from the carrying position.

37. A table comprising a table top having an upwardly facing surface and a downwardly facing surface, a frame coupled to the downwardly facing surface, and a handle movable between a carrying position and a stowed position, the handle having a handgrip and a coupler mounted to the frame and extending at least partially around the frame to support the hand grip for movement relative to the frame, wherein the handle includes a first half and a second half, the first half cooperating with the second half to form a loop when the handle is in an unassembled state, the first half configured to mate with the second half so that, when assembled, the coupler wraps at least partially around the frame to couple the handle to the frame and permit the handle to pivot about the frame.

* * * * *